US006439513B1

(12) United States Patent
Pascoe

(10) Patent No.: US 6,439,513 B1
(45) Date of Patent: Aug. 27, 2002

(54) PASSIVE DETECTION SYSTEM FOR LEVITATED VEHICLE OR LEVITATED VEHICLE SYSTEM

(75) Inventor: Robert D. Pascoe, Pittsburgh, PA (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 0 days.

(21) Appl. No.: 09/955,347

(22) Filed: Sep. 18, 2001

(51) Int. Cl.[7] ..... B61L 23/00
(52) U.S. Cl. ..... 246/122 R; 104/281
(58) Field of Search ..... 246/8, 63 R, 122 R, 246/122 A, 194; 191/10; 104/281, 284

(56) References Cited

U.S. PATENT DOCUMENTS

| | | | | | |
|---|---|---|---|---|---|
| 2,342,314 | A | * | 2/1944 | Wallace | 246/122 R |
| 3,526,378 | A | * | 9/1970 | Thorne-Booth | 246/122 R |
| 3,836,770 | A | * | 9/1974 | Helmcke et al. | 246/122 R |
| 4,038,653 | A | | 7/1977 | Brewster | |
| 4,487,385 | A | | 12/1984 | Salmon | |
| 4,603,640 | A | * | 8/1986 | Miller et al. | 104/282 |
| 4,661,799 | A | | 4/1987 | Buttemer | |
| 5,242,136 | A | * | 9/1993 | Cribbens et al. | 246/187 R |
| 5,517,924 | A | | 5/1996 | He et al. | |
| 5,586,504 | A | | 12/1996 | He et al. | |
| 5,868,360 | A | | 2/1999 | Bader et al. | |
| 6,011,508 | A | * | 1/2000 | Perreault et al. | 246/122 R |
| 6,044,770 | A | | 4/2000 | Davey et al. | |
| 6,100,820 | A | | 8/2000 | Pieverling | |
| 6,168,119 | B1 | | 1/2001 | Meier et al. | |

* cited by examiner

*Primary Examiner*—Mark T. Le
(74) *Attorney, Agent, or Firm*—Kirk D. Houser; Eckert Seamans Cherin & Mellott, LLC

(57) ABSTRACT

A passive detection system for a levitated vehicle includes track circuits. Each track circuit includes a detection loop having a cable with a first end, a length and a second end. The track circuit also includes a transmitter electrically connected to the first end of the cable and adapted to source a current to the detection loop, and a receiver electrically connected to the second end of the cable and adapted to sense the current from the detection loop. An inductor core includes two openings adapted to receive the length of the cable and two openings adapted to avoid the first and second ends of the cable. The inductor core is adapted to change the sensed current of the receiver, in order to detect a presence of the levitated vehicle at the detection loop. A member is adapted to support the inductor core from the vehicle.

20 Claims, 8 Drawing Sheets

FIG. 7
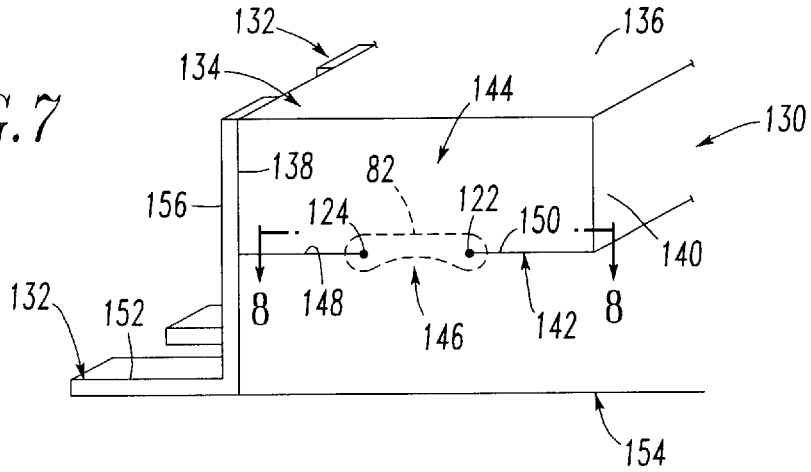
FIG. 9
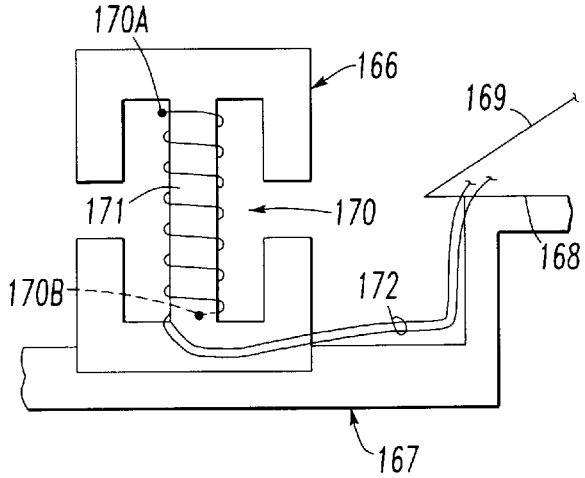
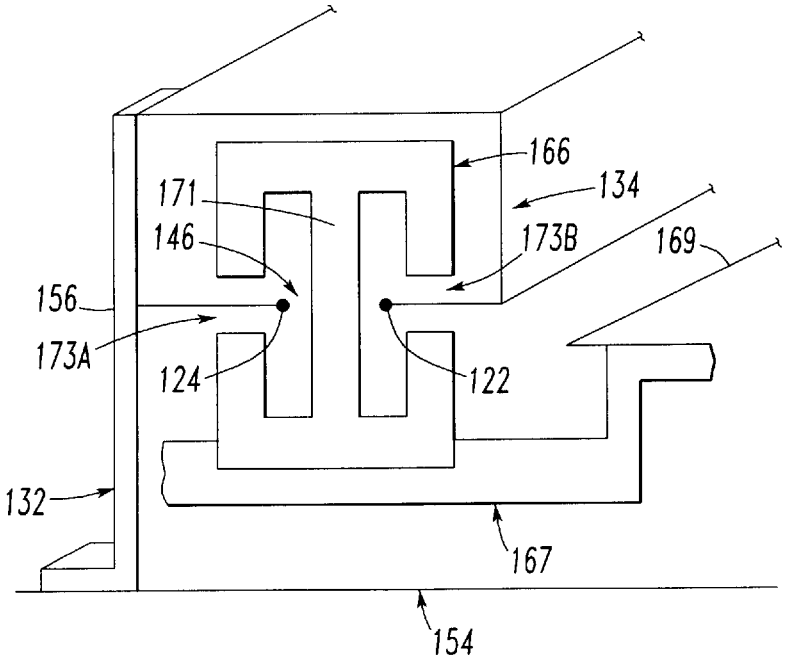
FIG. 10

FIG. 12
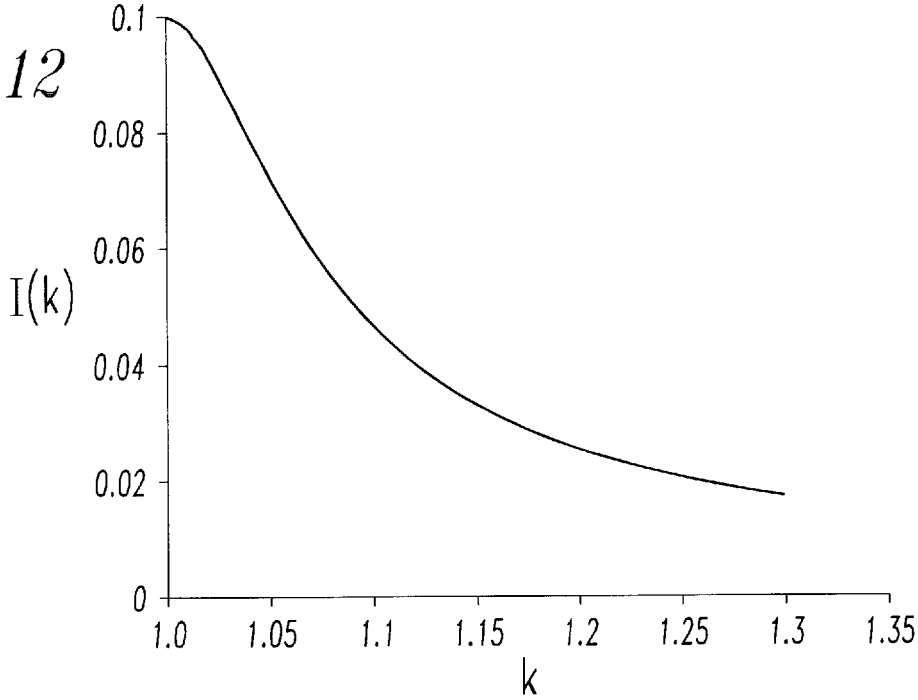
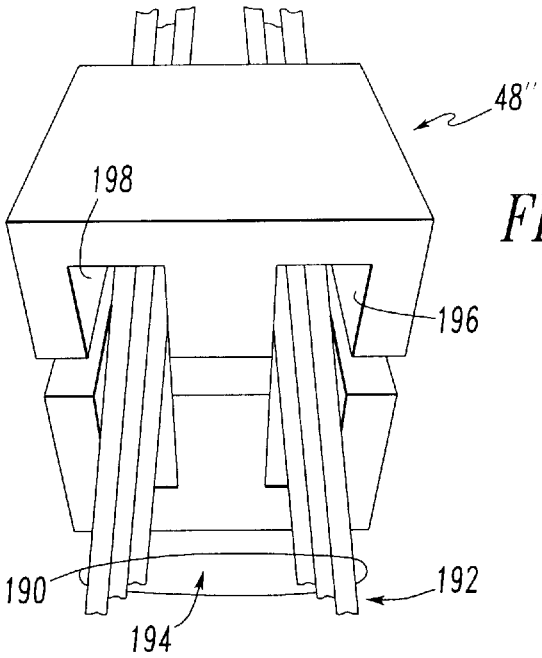
FIG. 13A
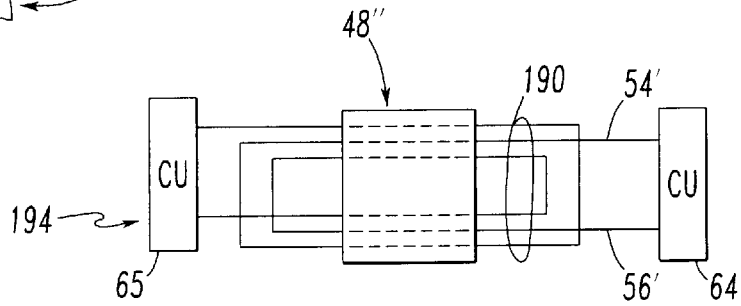
FIG. 13B

PASSIVE DETECTION SYSTEM FOR LEVITATED VEHICLE OR LEVITATED VEHICLE SYSTEM

BACKGROUND OF THE INVENTION

1. Field of the Invention

This invention relates to vehicle detection systems and, more particularly, to passive detection systems for a levitated vehicle or a levitated vehicle system, such as, for example, a MAGLEV system.

2. Background Information

Magnetic Levitated Vehicle (MAGLEV) systems are well known in the art. Examples are disclosed in U.S. Pat. Nos. 5,517,924; 5,586,504; and 6,044,770.

Most high-speed MAGLEVs are projected to run at speeds of about 150 to about 300 mph, while low-speed MAGLEVs are projected to run at speeds of up to about 30 to about 50 mph.

FIG. 1 shows a MAGLEV system 2 including a MAGLEV 4 and a guideway 6. The MAGLEV 4 moves over a suitable track having two rails 8,10. The number of rails may be modified, if desired. Extending from the MAGLEV 4 are magnetic sources (not shown), which are configured to flank each of the rails 8,10. These rails house composite coils (not shown). As the MAGLEV 4 travels along the track, its magnetic sources extend downward, with each source flanking one of the rails 8,10 and flanking the coils housed within it.

The track-based composite coils are incapable of levitating and stabilizing the MAGLEV 4 at low speeds. One alternative for addressing this low-speed problem is to affix wheels 12 to the bottom of the MAGLEV 4, in order to support the MAGLEV at certain speeds. The wheels 12 can be retracted as with conventional aircraft. Alternatively, the surface of the guideway 6 can be sloped away from the rail composite coil structure (not shown). Another alternative employs an additional coil (not shown) situated in the track.

FIG. 2 shows a conventional railroad track circuit 20 including a battery 22, a resistor 23, a track 24, and a relay 26. The feed or battery end and the relay end of the track circuit 20 are electrically connected to the two rails 27,28 of the track 24. Under conditions when a vehicle, such as a train (not shown), is not within the track circuit 20, the battery 22 energizes the coil 29 of the relay 26 through the series combination of the resistor 23, the first rail 27, the coil 29 and the second rail 28. In turn, the normally open contact 30 of the energized relay 26 closes as shown in FIG. 2.

As shown in FIG. 3, the track circuit 20 employs the shunting properties of a train's wheels and axle (i.e., a train shunt 32) to sufficiently reduce the current in the relay coil 29 and, thus, open the normally open contact 30, in order to indicate the presence of the train (not shown) in the track circuit 20. Hence, physical and electrical contact is required between the track rails 27,28 and the train shunt 32.

U.S. Pat. No. 4,661,799 discloses an inductive detector loop for detecting the presence of a vehicle. The front end of a receiver circuit includes a parallel tuned circuit having a tuning capacitor. A method of operating the detector loop includes the steps of energizing the loop with a first signal at a first frequency, monitoring the first signal to detect the presence of a vehicle within the electromagnetic area of the loop, transmitting a signal to the vehicle to activate a transmitter in order to transmit a second signal at a second frequency which is different from the first frequency, and monitoring the loop to detect the second signal.

U.S. Pat. No. 6,100,820 discloses a vehicle detector device having at least one inductive loop used as a sensor, and a phase/amplitude controller. The prior art section of U.S. Pat. No. 6,100,820 indicates that vehicle detectors are employed for purposes of detecting vehicles in traffic, and may be used to detect the presence, type and/or speed of such vehicles. Inductive loops are permanently embedded in the roadway of a traffic route-in a lane-related manner, if necessary. Vehicle detectors of this type using inductive loops as sensors exploit the effect that loop inductance varies depending on the metallic mass of a vehicle moving in the range of the inductive loop. In order to evaluate this effect, the inductive loop is accompanied by a modified capacitor to produce a resonant circuit, which is made to resonate by an excitation circuit. The resting frequency is defined as the frequency of this resonant circuit, which arises when a vehicle is not in the detection range of the inductive loop. The resonant frequency changes from the resting frequency when the loop inductance changes, caused by a vehicle. The amount of change is proportional to the mass of the detected vehicle.

There remains a substantial need for improvement in vehicle detection systems and, in particular, to such systems for a levitated vehicle or a levitated vehicle system, such as, for example, a MAGLEV system.

SUMMARY OF THE INVENTION

This need and others are met by the present invention, which employs an inductor core in combination with a detection loop of a track circuit. The inductor core includes openings adapted to receive a length of a track circuit cable, while avoiding the ends of that cable. The inductor core is adapted to change a sensed signal of a track circuit receiver, in order to detect the presence of a levitated vehicle at the detection loop.

As one aspect of the invention, a passive detection system for a levitated vehicle comprises: at least one track circuit including a detection loop having a cable with a first end, a length and a second end, the track circuit also including a transmitter electrically connected to the first end of the cable and adapted to source a signal to the detection loop, and a receiver electrically connected to the second end of the cable and adapted to sense the signal from the detection loop; an inductor core including two openings adapted to receive the length of the cable and two openings adapted to avoid the first and second ends of the cable, the inductor core adapted to change the sensed signal of the receiver of the track circuit in order to detect a presence of the levitated vehicle at the detection loop; and a member adapted to support the inductor core from the levitated vehicle.

Preferably, the cable of the detection loop of the track circuit has a plurality of turns, and one of the openings of the inductor core is adapted to receive the turns of the cable therein. The transmitter sources a current having a first value to the detection loop before the inductor core enters the detection loop. When the inductor core enters the detection loop the transmitter sources the current having a second value. The second value is less than the first value, a count of the turns of the cable is N, and a ratio of the first value to the second value is related to $N^2$.

As another aspect of the invention, a passive detection system for a levitated vehicle system comprises: a plurality of track circuits, each of the track circuits including a detection loop having a cable with a first end, a length and a second end, each of the track circuits also including a transmitter electrically connected to the first end of the cable and adapted to source a signal to the detection loop, and a receiver electrically connected to the second end of the cable and adapted to sense the signal from the detection loop; a plurality of members adapted to support the track circuits with respect to a guideway of the levitated vehicle system; an inductor core including two openings adapted to receive the length of the cable of one of the track circuits and two openings adapted to avoid the first and second ends of the cable, the inductor core adapted to change the sensed signal of the receiver of the one of the track circuits in order to detect a presence of the levitated vehicle at a corresponding one of the detection loops; and a member adapted to support the inductor core from a levitated vehicle of the levitated vehicle system.

Preferably, the cable of the detection loop of at least one of the track circuits includes first and second parallel conductors, first and second end segments adapted to electrically connect to the transmitter of the detection loop, and third and fourth end segments adapted to electrically connect to the receiver of the detection loop, with the first, second, third and fourth end segments being normal to the first and second parallel conductors. The inductor core may include first and second opposing E-shaped members, with each of the opposing E-shaped members having a base and first, second and third parallel legs disposed from the base, with the second parallel leg being disposed between the first and third parallel legs, with the first and second parallel legs of the first and second opposing E-shaped members forming a first opening adapted to receive the first parallel conductor, with the second and third parallel legs of the first and second opposing E-shaped members forming a second opening adapted to receive the second parallel conductor, with the first parallel legs of the first and second opposing E-shaped members being separated to form a third opening adapted to avoid the first and third end segments, and with the third parallel legs of the first and second opposing E-shaped members being separated to form a fourth opening adapted to avoid the second and fourth end segments.

The levitated vehicle may include a protection system, and the inductor core may further include a core member and an antenna element adapted to electrically connect to the protection system. The antenna element may include a plurality of windings around the core member and an electrical connection from the windings to the protection system.

Preferably, the cable of the detection loop of each of the track circuits includes first and second parallel conductors, first and second end segments adapted to electrically connect to the transmitter of the detection loop, and third and fourth end segments adapted to electrically connect to the receiver of the detection loop. The inductor core may include a first opening adapted to receive the first parallel conductor, a second opening adapted to receive the second parallel conductor, a third opening adapted to avoid the first and third end segments, and a fourth opening adapted to avoid the second and fourth end segments, in order to permit the inductor core to traverse from one of the track circuits to an adjacent one of the track circuits.

BRIEF DESCRIPTION OF THE DRAWINGS

A full understanding of the invention can be gained from the following description of the preferred embodiments when read in conjunction with the accompanying drawings in which:

FIG. 7 is an isometric end view of a cable channel and channel support for the track circuits of FIG. 6.

FIG. 9 is an elevational end view of a passive inductor core and a core support in accordance with another embodiment of the invention.

FIG. 10 is an elevational end view of the cable channel and channel support of FIG. 7 and the passive inductor core and core support of FIG. 9.

FIG. 12 is a plot of change in loop current versus percentage change in inductance in the guideway detection loop of FIG. 4.

FIG. 13A is an isometric view of passive inductor cores and cables in accordance with another embodiment of the present invention.

FIG. 13B is a block diagram in schematic form of the detection loop of FIG. 13A.

DESCRIPTION OF THE PREFERRED EMBODIMENTS

Figure 1:
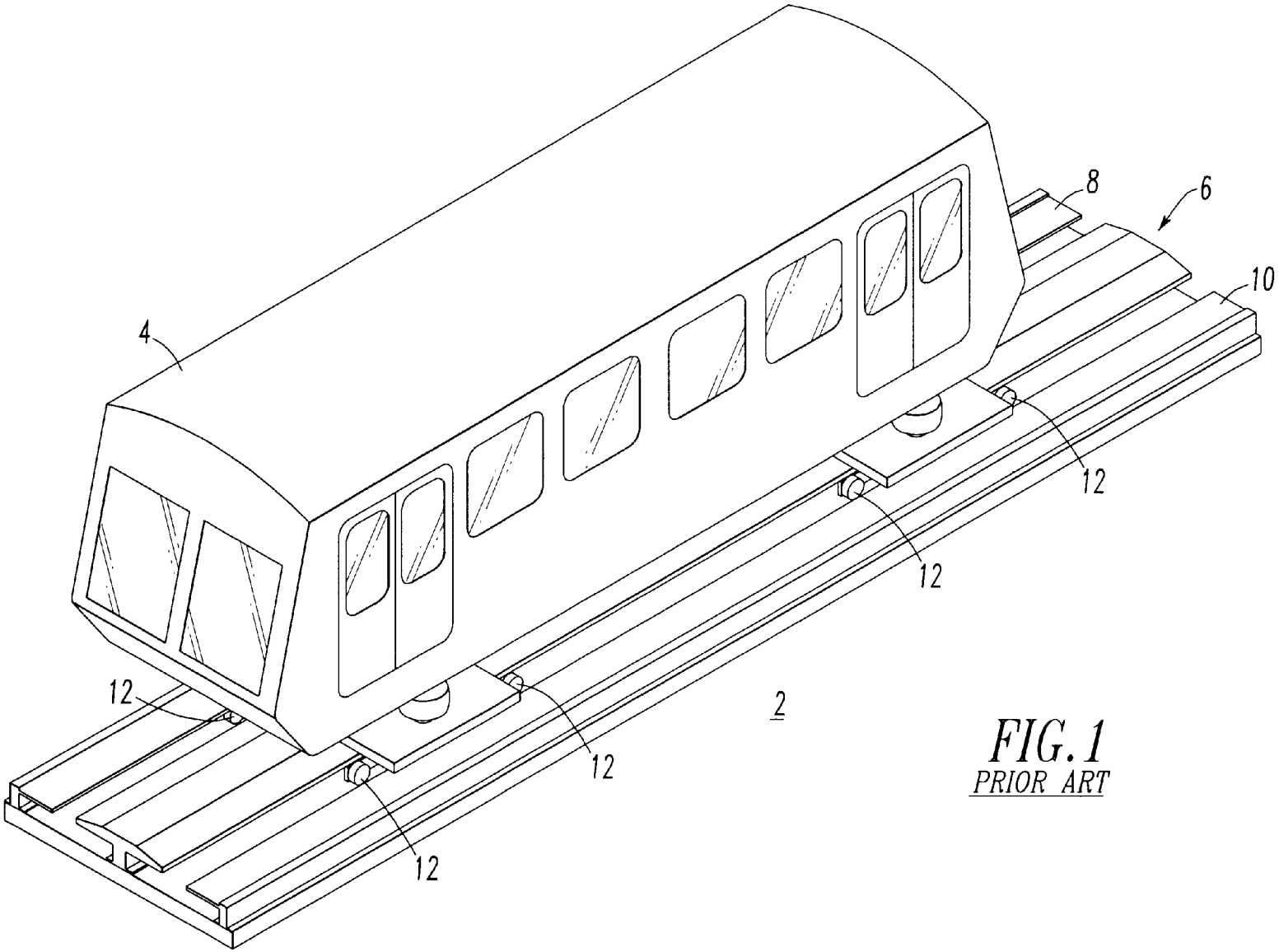
FIG. 1 PRIOR ART
FIG. 1 is an isometric view of a Magnetic Levitated Vehicle (MAGLEV) system including a MAGLEV and a guideway.
Figure 2:
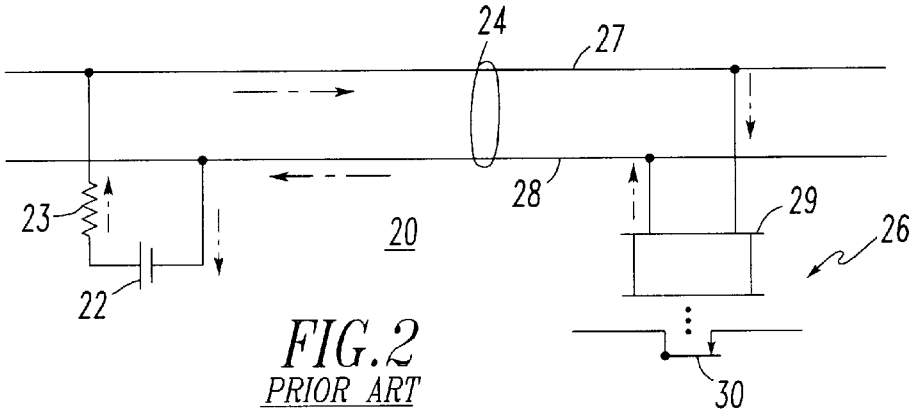
FIG. 2 PRIOR ART
FIG. 2 is a block diagram in schematic form of a conventional track circuit.
Figure 3:
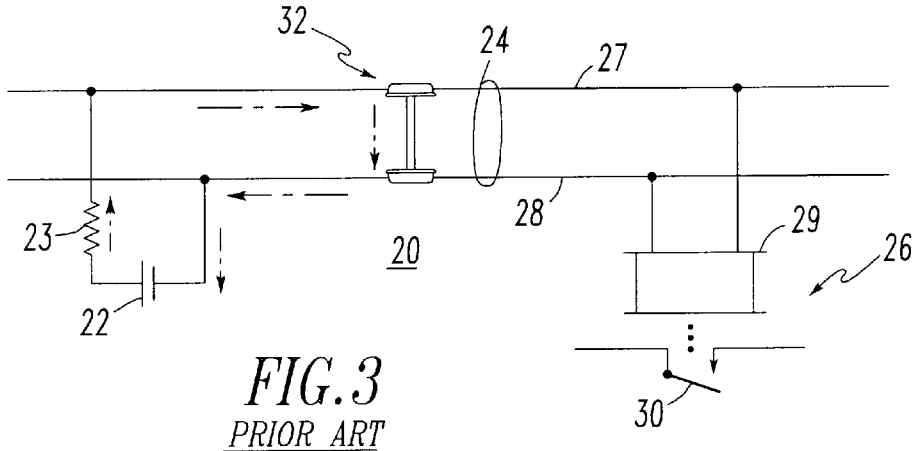
FIG. 3 PRIOR ART
FIG. 3 is block diagram in schematic form of the conventional track circuit of FIG. 2 including a conventional train shunt.
Figure 4:
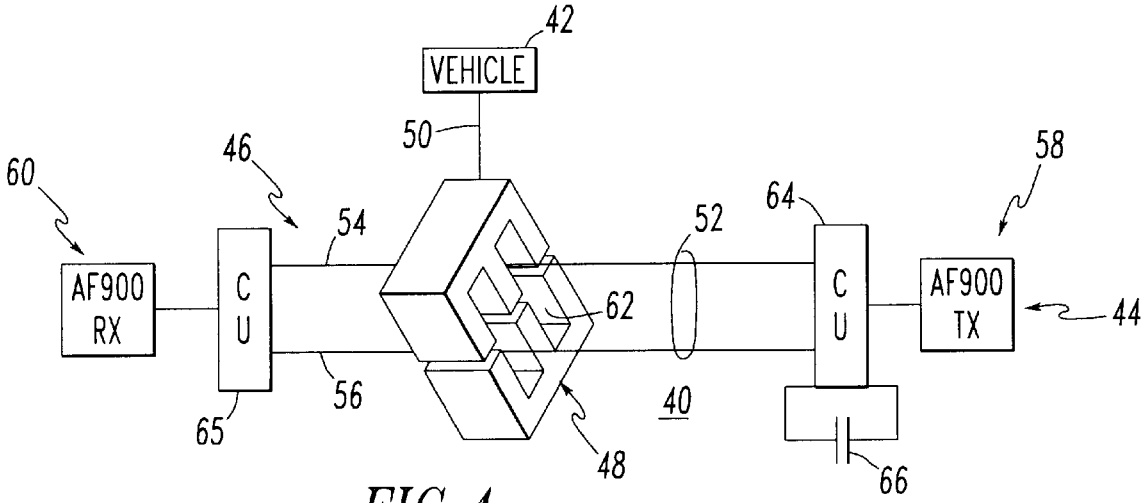
FIG. 4 is a block diagram of a passive detection system including a track circuit employing a guideway detection loop and passive inductor cores in accordance with an embodiment of the present invention.

FIG. 4 shows a passive detection system 40 for a levitated vehicle, such as the exemplary MAGLEV 42. The system 40 includes a track circuit 44 having a guideway detection loop 46 and one or more passive inductor cores 48, which are suspended from the MAGLEV 42 by a support member 50, which is suitably adapted to support the cores 48 from the MAGLEV 42.

The detection loop 46 includes a cable 52 having two conductors 54,56, with a first (transmitter) end, a length and a second (receiver) end. The track circuit 44 also includes a transmitter 58 and a receiver 60. The transmitter 58 is electrically connected to the first end of the cable 52 and adapted to source a current to the detection loop 46. The receiver 60 is electrically connected to the opposite second end of the cable 52 and is adapted to sense the current from the detection loop 46. The exemplary cores 48 include openings 62, which are adapted to receive, but not engage, the length of the cable 52. The cores 48 are preferably made of a ferrous material and are adapted to change the sensed current of the receiver 60, in order to detect the presence of the MAGLEV 42 at the detection loop 46. As discussed below in connection with FIG. 6, the coils 48 and openings 62 are suitably adapted to avoid the transmitter and receiver ends of the cable 52 as the MAGLEV 42 moves into and out of the detection loop 46. Accordingly, the exemplary system 40 advantageously determines the location of the MAGLEV 42 without employing any electrical or physical connection between that MAGLEV and the detection loop 46, the MAGLEV guideway (not shown) or any associated structure.

Without the MAGLEV's exemplary inductor cores 48 in the detection loop 46, a maximum level of current is sensed by the receiver 60. On the other hand, once the cores 48 magnetically or physically enter the detection loop 46, the receiver's current substantially decreases because of the de-tuning of the detection loop 46, as discussed below in connection with FIG. 12.

An example of a track circuit product including the exemplary transmitter 58 and receiver 60 is an AF900 track circuit marketed by the assignee of the present invention, Union Switch & Signal, Inc. of Pittsburgh, Pa. The exemplary AF900 contains four track circuits (not shown) in one cardfile (not shown) and is wired as a normal track circuit having the AF900 TX transmitter 58 and AF900 RX receiver 60.

The exemplary guideway detection loop 46 of the track circuit 44 is tuned to a suitable frequency by an external tuning capacitor 66 of the transmitter coupling unit (CU) 64. The exemplary detection loop 46 represents a detection zone (e.g., without limitation, about every 100 feet; 1000 feet; up to several km (total loop length)) for the exemplary MAGLEV 42. The exemplary coupling unit 64 may be series (e.g., for relatively shorter-length detection zones) or parallel (e.g., for relatively longer-length detection zones) resonated via the tuning capacitor 66 at the carrier frequency of the exemplary AF900 track circuit product (e.g., 8 discrete frequencies, 9.5 kHz to 16.5 kHz).

For example, for purpose of illustration, the detection loop 46 of FIG. 4 employs a low impedance transmitter 58 and is series tuned with the tuning capacitor 66. The increase in inductance of the detection loop 46 caused by the presence of the passive inductor cores 48 causes the current of the detection loop 46 to decrease because of the de-tuning of the series resonant circuit. The Q of the series circuit magnifies the effect of the increase in the detection loop inductance. With the decrease in loop current, a level detector (not shown) of the receiver 60 shows an "occupied" condition of the detection loop 46.

The exemplary inductor cores 48 behave as a transformer and increase the inductance of the detection loop 46. Preferably, the configuration of the track circuit 44 employs a "closed loop," such that any fault (e.g., an open tuning capacitor 66, an open detection loop 46, a failure of the loop transmitter 58) results in the loop receiver 60 safely indicating an "occupied" detection loop condition.

Figure 5:
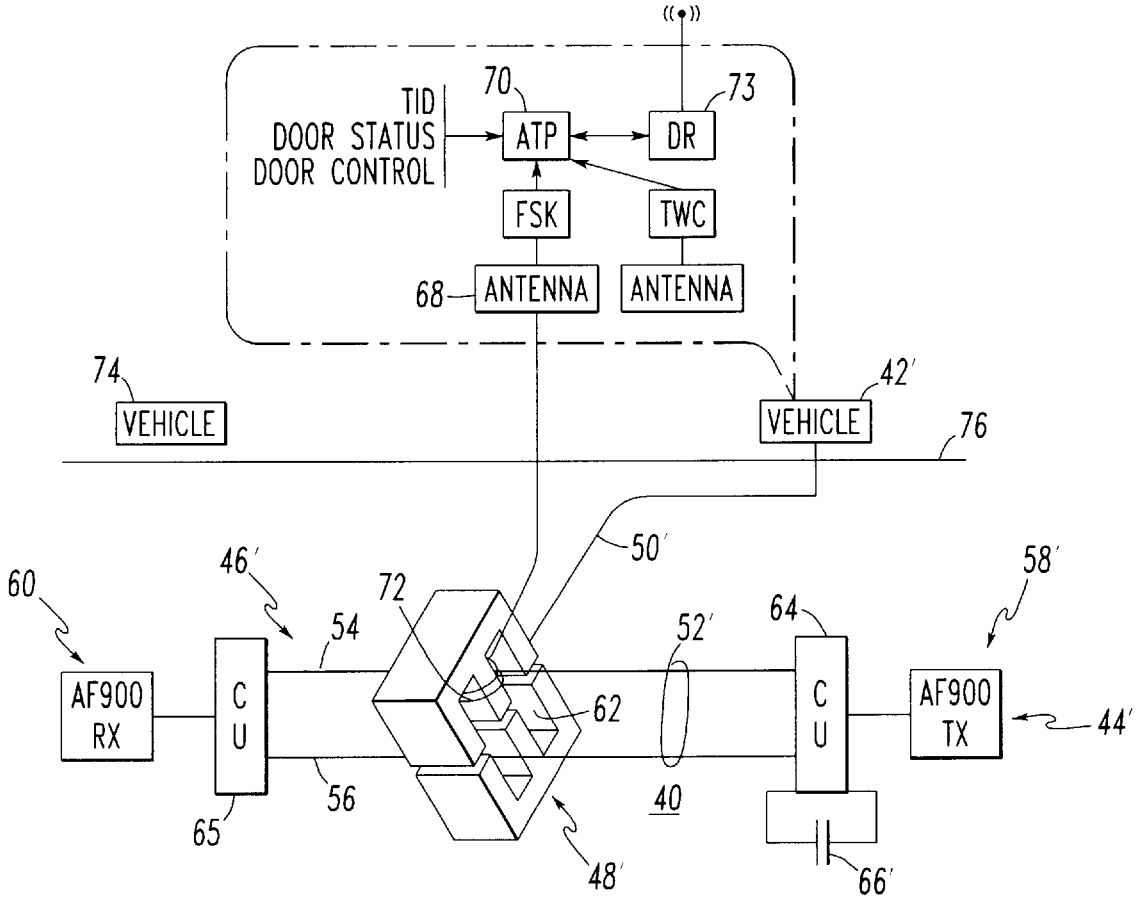
FIG. 5 is a block diagram of a passive detection system including a track circuit employing a guideway detection loop and passive inductor cores, which function as an antenna for a vehicle's automatic train protection equipment (ATP), in accordance with another embodiment of the present invention.

Alternatively, in the embodiment of FIG. 5, the track circuit 44' employs a high impedance transmitter 58' and is parallel tuned with an external capacitor 66'. The receiver 60 is in series with the detection loop 46'. At resonance, the line current from the transmitter 58' to the parallel tuning circuit is minimum and the loop current in the cable 52' is maximum (i.e., Q times the line current). The increase in inductance caused by the passive inductor cores 48' causes the loop current to decrease. With the decrease in loop current, the level detector (not shown) of the receiver 60 shows an "occupied" condition of the detection loop 46'. Similarly, a failure condition causes the loop current to decrease (e.g., to zero) and the receiver 60 safely shows the "occupied" condition.

Preferably, the MAGLEVs 42',74 are "passive" in that their motion is controlled by the MAGLEV guideway 76 and not by devices onboard the MAGLEVs. As discussed below in connection with FIGS. 6 and 8, a guideway is organized into "zones". An inverter (not shown) controls each zone and determines the motion of the MAGLEV via a linear synchronous motor (not shown). Thus, the zone inverter controls the MAGLEV's physical motion (e.g., accelerating, decelerating, speed regulation).

Preferably, as shown in FIG. 5, the passive inductor cores 48' also function as an antenna 68 for automatic train protection equipment (ATP) 70 of the MAGLEV 42'. Similar to the cores 48 of FIG. 4, the cores 48' are mounted on the MAGLEV 42' and are suitably suspended by the support 50' to encompass the detection loop 46', which also advantageously functions as a wayside loop. A winding 72 disposed around a central portion of the cores 48' advantageously permits the MAGLEV's ATP equipment 70 to receive digital data as transmitted by the loop transmitter 58'.

For example, the data decoded by the ATP equipment 70 includes a unique digital loop identification number. Hence, the MAGLEV 42' is always receiving information concerning the integrity of the detection loop 46'. This advantageously provides a check that the inductor cores 48' are connected to the MAGLEV 42', as well as a vital wayside communication path through the cores 48' and the windings 72, in order to permit the ATP equipment 70 to receive the digital data from the loop 46'. Thus, if at any time, the MAGLEV 42' does not detect cab signaling current (e.g., loop identification number; radio frequency channel) from the loop 46', then the ATP equipment 70 vitally communicates (e.g., by radio frequency channel communication through data radio (DR) 73) the "lack of cab signaling" to the wayside (not shown). In turn, the wayside requests that the inverters (not shown) controlling the MAGLEVs 42',74 on the system guideway 76 be shut down.

As discussed above, the exemplary AF900 track circuit 44' is employed for both MAGLEV detection and transponder location information. The transponder permits the train's ATP equipment 70 to recalibrate distance measurement data. The MAGLEV detection, however, is an independent system that determines the location of each MAGLEV in a zone as defined by a corresponding detection loop, such as 46'.

Figure 6:
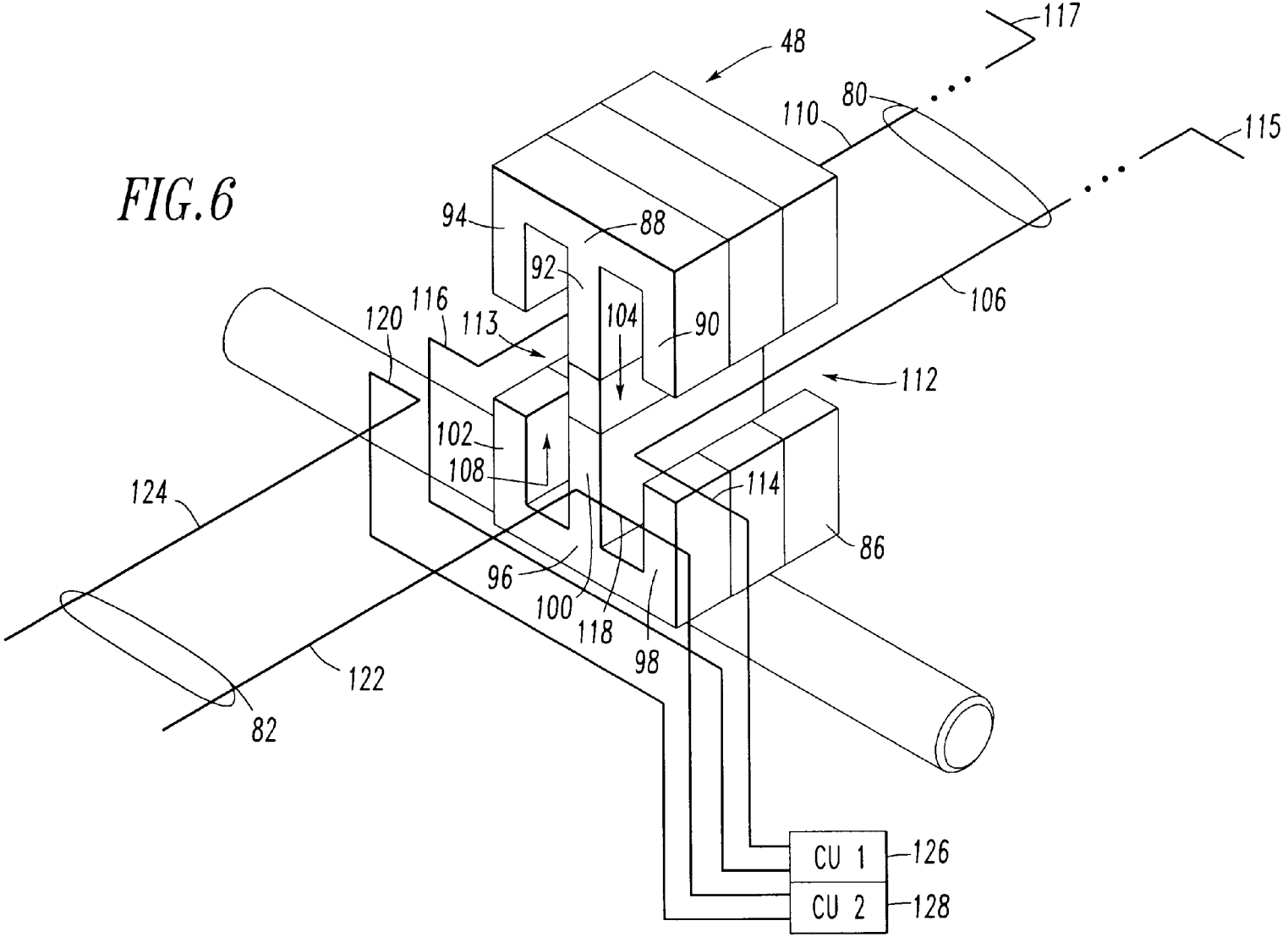
FIG. 6 is an isometric view of two track circuits and the passive inductor cores of FIG. 4 in accordance with another embodiment of the present invention.

FIG. 6 shows the exemplary inductor cores 48 of FIG. 4 traversing from one detection loop 80 to an adjacent detection loop 82. Those loops 80,82 are similar to the detection loop 46 of FIG. 4. The exemplary inductor cores 48, which are carried by the MAGLEV 42 of FIG. 4, include first and second opposing E-shaped core members 84,86. The first E-shaped core member 84 has a base 88 and first, second and third parallel legs 90,92,94 disposed from the base 88. Similarly, the second E-shaped core member 86 has a base 96 and first, second and third parallel legs 98,100,102 disposed from the base 96. The first and second parallel legs 90,92,98,100 of the members 84,86 form a first opening 104 adapted to receive a first parallel conductor 106 of the detection loop 80. Similarly, the second and third parallel legs 92,94,100,102 of the members 84,86 form a second opening 108 adapted to receive a second parallel conductor 110 of the detection loop 80.

The first parallel legs 90,98 of the members 84,86 are suitably separated to form a third opening 112 adapted to avoid the end segments 114,115 of the first conductor 106 of the detection loop 80. Similarly, the third parallel legs 94,102 of the members 84,86 are suitably separated to form a fourth opening 113 adapted to avoid the end segments 116,117 of the second conductor 110 of the detection loop 80. In a like manner, the third and fourth openings 112,113 are adapted to avoid the end segments 118,120 of the conductors 122,124, respectively, of the adjacent detection loop 82. In this manner, the inductor cores 48 having the openings 104,108,112,113 advantageously traverse between the detection loops 80,82 of the adjacent track circuits shown in FIG. 6, while also remaining electrically and physically separated from the guideway components (not shown) of the MAGLEV system and the individual track circuits.

As shown in FIG. 6, the end segments 114,116 of the detection loop 80 are adapted to electrically connect to the first coupling unit (CU1) 126 (e.g., associated with the transmitter 58 of FIG. 4). The end segments 118,120 of the detection loop 82 are adapted to electrically connect to the second coupling unit (CU2) 128 (e.g., associated with a receiver, similar to the receiver 60 of FIG. 4). In a like manner, the end segments 115,117 of the detection loop 80 are adapted to electrically connect to a second coupling unit (not shown) (e.g., similar to CU2 128, but associated with the receiver 60 of FIG. 4).

As also shown in FIG. 6, the end segments 114,115,116, 117 and 118,120 are preferably normal with respect to the parallel conductors 106,110 and 122,124, respectively. The cores 84,86 are adapted, through the openings 104,108, to receive the length of the cable conductors 106,110 and 122,124 of the detection loops 80 and 82, respectively, of the adjacent track circuits. Furthermore, the cores 84,86 are adapted, through the openings 112 and 113, to avoid the ends 115,114,118 and 117,116,120 of the conductors 106,122 and 110,124, respectively. With the MAGLEV (not shown) and the cores 84,86 moving from the top right to the bottom left of FIG. 6, the cores permit the receivers (not shown) corresponding to the detection loops 80,82 to first detect the presence of the MAGLEV at the detection loop 80 (as shown in FIG. 6) followed by detection of the presence of the MAGLEV at the detection loop 82 (assuming the exemplary motion described above).

FIG. 7 shows an exemplary cable channel 130 and a plurality of channel supports 132 for detection loops and corresponding track circuits, such as the detection loops 80,82 of FIG. 6. The exemplary cable channel 130 includes a suitable shell, such as the exemplary fiberglass shell 134 having a top 136, two sides 138,140, a partially open bottom 142, and two open ends (only the open end 144 is shown). The shell bottom 142 has an opening 146 disposed between two side portions 148,150, which portions provide support for a plurality of cables of plural detection loops, such as the conductors 122,124 of the detection loop 82 of FIG. 6. The exemplary channel support 132 is an L-shaped member having a first leg 152, which is suitably attached to a guideway 154 of a MAGLEV system (not shown), and a second leg 156, which is suitably attached to the side 138 of the cable channel shell 134. As will be explained in greater detail below in connection with FIG. 10, the channel supports 132 support the cable channel shell 134 a suitable distance above the guideway 154, in order to accommodate the passive inductor core 166 and core support 167.

Figure 8:
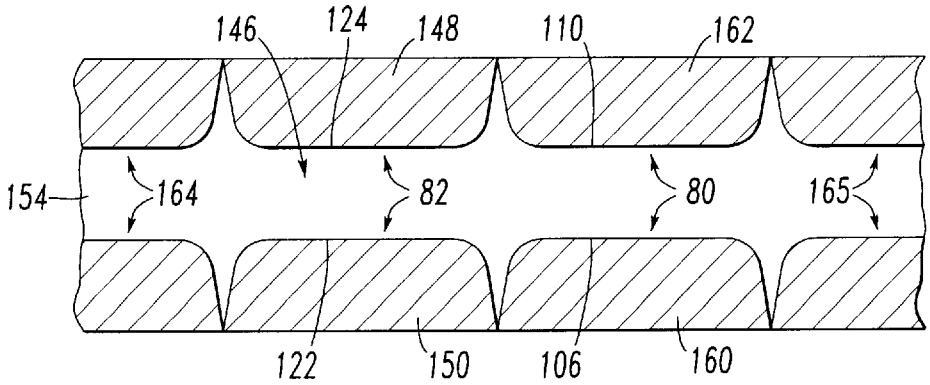
FIG. 8 is a cross-sectional view along lines 8—8 of FIG. 7 showing support for a plurality of track circuit cables.

FIG. 8 shows the two side portions 148,150 of the shell bottom 142 of FIG. 7 positioned above the guideway 154 and providing support for the conductors 122,124 of the detection loop 82 of FIG. 6. Similarly, two side portions 160,162 of the shell bottom 142 of FIG. 7 provide support for the conductors 106,110 of the detection loop 80 of FIG. 6. Thus, the shell bottom 142 of FIG. 7 provides support for a sequence of detection loops 164,82,80,165 (only 82 is shown in FIG. 7) and corresponding track circuit cables positioned above the length of the guideway 154.

As can be seen with reference to FIGS. 7 and 8, a plurality of track circuit cables, such as the conductors 122,124 of the detection loop 82 of FIG. 8, are supported by a plurality of cable supports, such as the two side portions 150,148 of the shell bottom 142 of FIG. 7, which, in turn, arc supported by the cable channel 130, the channel supports 132 and the guideway 154.

FIG. 9 shows the passive ferrous inductor core 166, which is similar in structure to the opposing E-shaped core members 84,86 of FIG. 6, and the nonferrous core support 167, which is suitably attached to a surface 168 of a MAGLEV 169. Similar to the cores 48' and winding 72 of FIG. 5, the unitary core 166 has an antenna element, such as the exemplary plural-turn pick-up winding 170, disposed around a center portion 171 of the core 166. A suitable electrical connection, such as the exemplary twisted pair wire 172, electrically connects the ends 170A,170B of the winding 170 to the ATP equipment (e.g., 70 of FIG. 5) of the MAGLEV 169. The twisted pair wire 172 is preferably placed on and generally follows the mechanical support 167 holding the core 166 to the MAGLEV 169. As discussed above in connection with FIG. 5, the winding 170 permits the MAGLEV's ATP equipment 70 to sequentially receive digital data as transmitted by the various detection loops, such as loops 164,82,80,165 of FIG. 8.

FIG. 10 shows the core 166 and support 167 of FIG. 9 positioned above the guideway 154 and partially within the cable channel shell 134 of FIG. 7. The opening 146 of the shell bottom 142 of FIG. 7 provides suitable clearance for the center portion 171 of the core 166. The length of the support leg 156 and the position of the cable channel shell 134 thereon above the guideway 154 provide suitable clearance between the guideway 154 and the core support 167 at the bottom of the core 166. The length of the core support 167 provides suitable clearance between the cable channel shell 134 and the MAGLEV 169. The gaps 173A,173B in the sides of the core 166 provide suitable clearance between the core 166 and the shell bottom 142 of FIG. 7.

Figure 11:
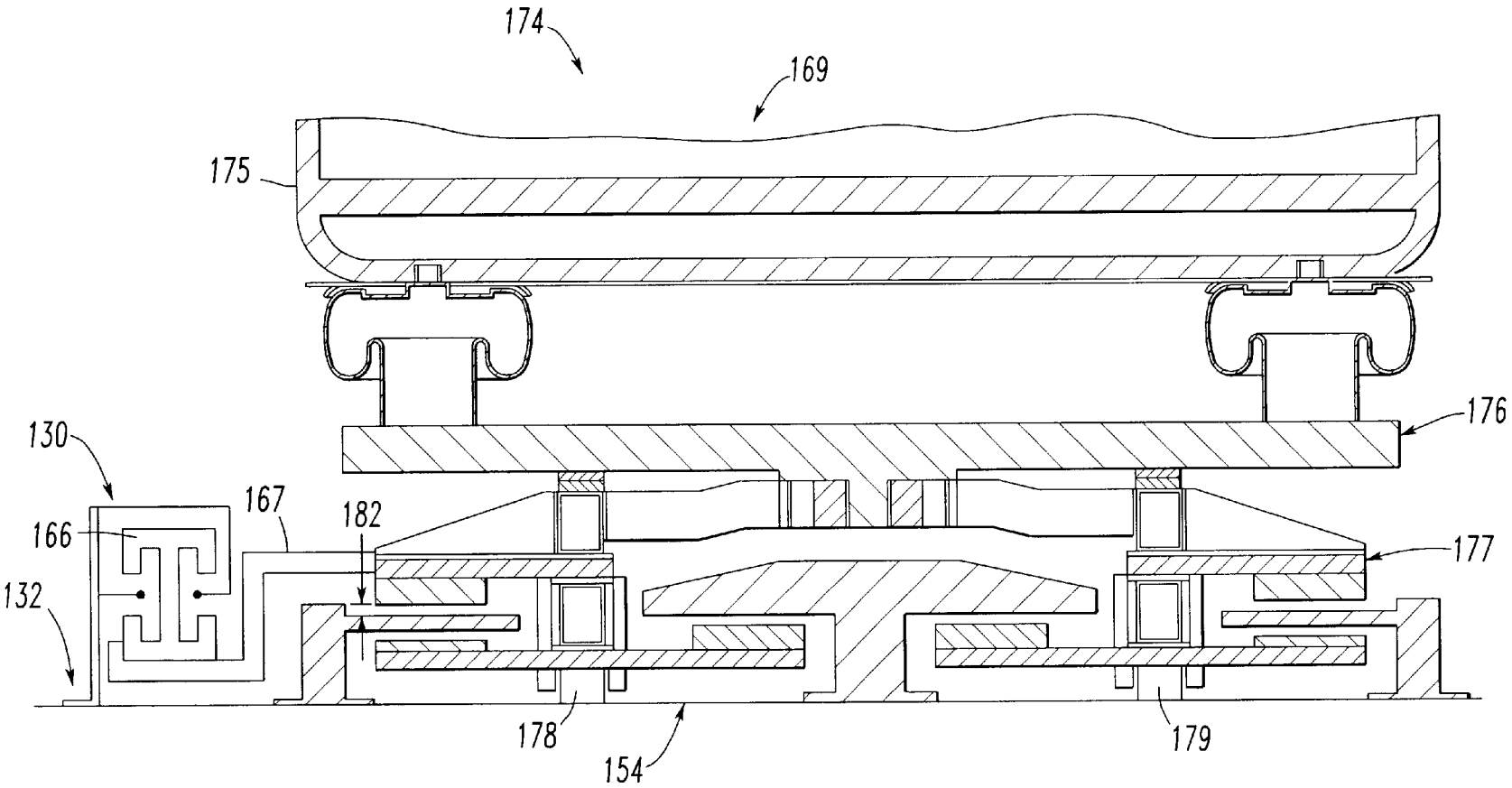
FIG. 11 is an elevational end view of the cable channel, channel support, passive inductor core and core support of FIG. 10 in combination with a MAGLEV and guideway in accordance with another embodiment of the invention.

FIG. 11 shows the cable channel 130, the channel support 132, the passive inductor core 166 and core support 167 of FIG. 10 in combination with the MAGLEV 169 and guideway 154 of a MAGLEV system 174. The exemplary MAGLEV 169 includes a cab portion 175, a bolster assembly 176 and a bogie assembly 177 having plural landing wheels, such as 178,179. Normally, however, the wheels 178,179 are retracted and a suitable clearance 182 is maintained between the moving MAGLEV 169 and the guideway 154.

FIG. 12 shows a plot of change in loop current, I(k), versus percentage change in inductance, k, in the guideway detection loop 46 of FIG. 4. Once the inductor cores 48 of the MAGLEV 42 magnetically or physically enter the detection loop 46, the sensed current of the receiver 60 substantially decreases because of the de-tuning of the detection loop 46. Hence, with no physical contact to the detection loop, the function of MAGLEV detection is achieved. For example, with a 1000-foot detection loop circuit and a core located in the detection loop, there is about a 15–20% change in inductance and a corresponding change in current, and with a 100-foot detection loop circuit, there is about a 30–40% change in inductance and a relatively greater corresponding change in current.

FIGS. 13A and 13B show passive inductor cores 48" and a detection loop cable 190 having a plurality of turns 192. For example, if three turns are employed, then the conductors 54',56' of FIG. 13B, which originate at the transmitter CU 64, pass through the openings 196,198, respectively, three times before ending at the receiver CU 65. Hence, the exemplary loop cable 190 is about three times longer than the cable 52 of FIG. 4 for an equivalent length between the CUs 64,65. The effect of the inductor cores 48 of FIG. 4 may advantageously be enhanced by employing the plural turns 192 in the construction of the detection loop 194 of FIGS. 13A and 13B. The openings 196,198 of the inductor cores 48" are adapted to receive the cable turns 192 therein. For example, if the count of the cable turns 192 is N (e.g., without limitation, 2, 3, 4 or more), then a ratio of a first current value without the presence of the MAGLEV to a second current value with the presence of the MAGLEV (and the cores 48") is related to $N^2$ (e.g., without limitation, 4, 9, 16 or more) and, thus, the effect is enhanced by $N^2$.

Figure 14A:
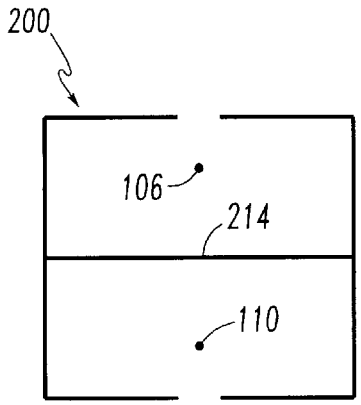
FIGS. 14A–14E are elevational end views of passive inductor cores for track circuit cables in accordance with other embodiments of the invention.
Figure 14B:
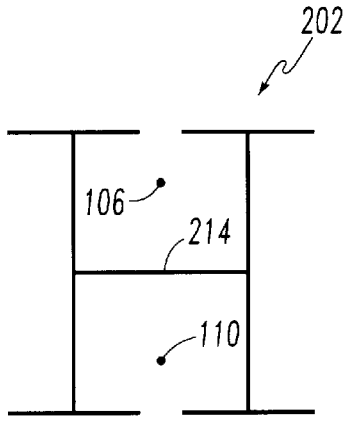
Figure 14C:
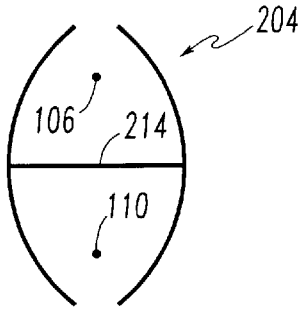
Figure 14D:
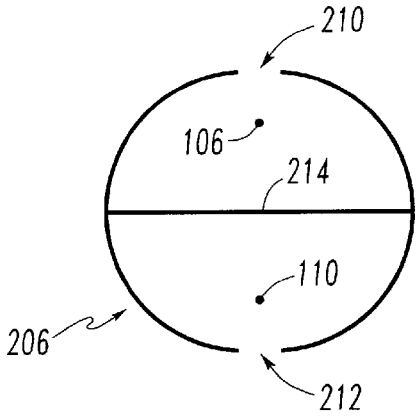
Figure 14E:
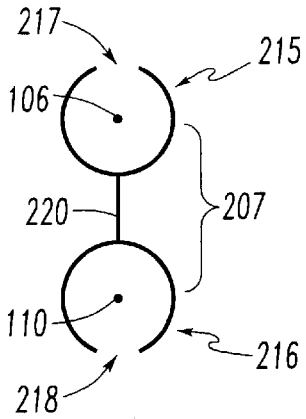

FIGS. 14A–14E show alternative passive inductor cores 200, 202, 204, 206, 207, which are disposed about the conductors 106,110 of the detection loop 80 of FIG. 6 in an analogous manner as the opposing E-shaped core members 84,86. These exemplary inductor cores include the core 200 formed by opposing square C-shaped core members (FIG. 14A); the core 202 formed by opposing I-shaped core members (FIG. 14B); the core 204 formed by opposing arcuate C-shaped core members (FIG. 14C); the core 206 formed by a cylindrical core member having two air gaps 210,212 and a central support member 214 (FIG. 14D); and the core 207 formed by dual cores 215,216 each of which has an air gap 217,218, respectively, and a common support member 220 (FIG. 14E). The two-piece cores 200,202,204, 206 and 207 employ support members 214 and 220, respectively.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A passive detection system for a levitated vehicle, said system comprising:

at least one track circuit including a detection loop having a cable with a first end, a length and a second end, said track circuit also including a transmitter electrically connected to the first end of the cable and adapted to source a signal to the detection loop, and a receiver electrically connected to the second end of the cable and adapted to sense said signal from the detection loop;

an inductor core including two openings adapted to receive the length of the cable and two openings adapted to avoid the first and second ends of said cable, said inductor core adapted to change the sensed signal of the receiver of said track circuit in order to detect a presence of said levitated vehicle at the detection loop; and a member adapted to support said inductor core from said levitated vehicle.

2. The passive detection system of claim 1 wherein said inductor core further includes a core element made of a ferrous material; and wherein said member adapted to support said inductor core is made of a nonferrous material.

3. The passive detection system of claim 1 wherein said transmitter sources a current having a first value to the detection loop before said inductor core enters said detection loop; and wherein when said inductor core enters said detection loop said transmitter sources the current having a second value to the detection loop, said second value being less than said first value.

4. The passive detection system of claim 1 wherein the cable of the detection loop of said track circuit has a plurality of turns; and wherein one of the openings of said inductor core is adapted to receive the turns of said cable therein.

5. The passive detection system of claim 4 wherein said transmitter sources a current having a first value to the detection loop before said inductor core enters said detection loop; wherein when said inductor core enters said detection loop said transmitter sources the current having a second value to the detection loop, said second value being less than said first value; wherein a count of the turns of said cable is N; and wherein a ratio of the first value to the second value is related to $N^2$.

6. The passive detection system of claim 1 wherein said track circuit further includes a tuning capacitor; and wherein the detection loop is resonated by the tuning capacitor.

7. The passive detection system of claim 6 wherein said detection loop is series resonated by the tuning capacitor.

8. The passive detection system of claim 6 wherein said detection loop is parallel resonated by the tuning capacitor.

9. The passive detection system of claim 1 wherein the cable of the detection loop of said track circuit includes first and second parallel conductors; and wherein said inductor core includes a first opening adapted to receive the first parallel conductor and a second opening adapted to receive the second parallel conductor.

10. The passive detection system of claim 9 wherein the cable of the detection loop of said track circuit further includes first and second end segments adapted to electrically connect to the transmitter of said detection loop and third and fourth end segments adapted to electrically connect to the receiver of said detection loop, with the first, second, third and fourth end segments being normal to said first and second parallel conductors; and wherein said inductor core further includes a third opening adapted to avoid the first and third end segments, and a fourth opening adapted to avoid the second and fourth end segments.

11. A passive detection system for a levitated vehicle system including a levitated vehicle and a guideway, said passive detection system comprising:

a plurality of track circuits, each of said track circuits including a detection loop having a cable with a first end, a length and a second end, each of said track circuits also including a transmitter electrically connected to the first end of the cable and adapted to source a signal to the detection loop, and a receiver electrically connected to the second end of the cable and adapted to sense said signal from the detection loop;

a plurality of members adapted to support said track circuits with respect to the guideway of said levitated vehicle system;

an inductor core including two openings adapted to receive the length of the cable of one of said track circuits and two openings adapted to avoid the first and second ends of said cable, said inductor core adapted to change the sensed signal of the receiver of said one of said track circuits in order to detect a presence of said levitated vehicle at a corresponding one of the detection loops; and a member adapted to support said inductor core from said levitated vehicle.

12. The passive detection system of claim 11 wherein said inductor core is electrically isolated from said track circuits and the guideway of said levitated vehicle system.

13. The passive detection system of claim 11 wherein said inductor core is physically separated from said track circuits and the guideway of said levitated vehicle system.

14. The passive detection system of claim 11 wherein said guideway has a length; and wherein said track circuits are disposed along the length of said guideway.

15. The passive detection system of claim 11 wherein said levitated vehicle includes a protection system; wherein said inductor core includes a core element made of a ferrous material, and an antenna element adapted to electrically connect to said protection system; and wherein said member adapted to support said inductor core is made of a nonferrous material.

16. The passive detection system of claim 11 wherein the cable of the detection loop of at least one of said track circuits includes first and second parallel conductors, first and second end segments adapted to electrically connect to the transmitter of said detection loop, and third and fourth end segments adapted to electrically connect to the receiver of said detection loop, with the first, second, third and fourth end segments being normal to said first and second parallel conductors; and wherein said inductor core includes first and second opposing E-shaped members, with each of said opposing E-shaped members having a base and first, second and third parallel legs disposed from the base, with the second parallel leg being disposed between the first and third parallel legs, with the first and second parallel legs of the first and second opposing E-shaped members forming a first opening adapted to receive the first parallel conductor, with the second and third parallel legs of the first and second opposing E-shaped members forming a second opening adapted to receive the second parallel conductor, with the first parallel legs of the first and second opposing E-shaped members being separated to form a third opening adapted to avoid the first and third end segments, and with the third parallel legs of the first and second opposing E-shaped members being separated to form a fourth opening adapted to avoid the second and fourth end segments.

17. The passive detection system of claim 11 wherein said levitated vehicle includes a protection system; and wherein said inductor core further includes a core member and an antenna element adapted to electrically connect to said protection system, said antenna element including a plurality of windings around the core member and an electrical connection from said windings to said protection system.

18. The passive detection system of claim 17 wherein said electrical connection generally follows said member adapted to support said inductor core.

19. The passive detection system of claim 11 wherein the cable of the detection loop of each of said track circuits includes first and second parallel conductors, first and second end segments adapted to electrically connect to the transmitter of said detection loop, and third and fourth end segments adapted to electrically connect to the receiver of said detection loop; and wherein said inductor core includes a first opening adapted to receive the first parallel conductor, a second opening adapted to receive the second parallel conductor, a third opening adapted to avoid the first and third end segments, and a fourth opening adapted to avoid the second and fourth end segments, in order to permit said inductor core to traverse from one of said track circuits to an adjacent one of said track circuits.

20. The passive detection system of claim 11 wherein each of the detection loops of said track circuits includes a cable; wherein said members adapted to support said track circuits include a cable channel to support said cables and a channel support to support said cable channel with respect to the guideway of said levitated vehicle system.

* * * * *